United States Patent [19]

Sharp et al.

[11] Patent Number: 4,748,874

[45] Date of Patent: Jun. 7, 1988

[54] WRENCHES

[76] Inventors: Peter G. Sharp, 4410 Hillside Dr., Louisville, Ky. 40216; George Spector, 233 Broadway, RM 3815, New York, N.Y. 10007

[21] Appl. No.: 6,772

[22] Filed: Jan. 27, 1987

[51] Int. Cl.[4] ..... B25B 13/00

[52] U.S. Cl. ..... 81/58.1; 81/177.2; 81/177.6; 81/177.7

[58] Field of Search ..... 81/58.1, 124.7, 177.5–177.8, 81/177.2

[56] References Cited

U.S. PATENT DOCUMENTS

| | | | |
|---|---|---|---|
| 337,986 | 3/1886 | Palmer | 81/177.7 |
| 928,003 | 7/1909 | Peterson | 81/177.6 |
| 2,680,985 | 6/1954 | Fish | 81/177.7 |
| 2,891,434 | 6/1959 | Lozensky | 81/60 |
| 3,332,304 | 7/1967 | Lynn | 81/58.1 |
| 4,611,514 | 9/1986 | Hyde | 81/60 |

FOREIGN PATENT DOCUMENTS

| | | | |
|---|---|---|---|
| 1404851 | 9/1975 | United Kingdom | 81/177.7 |

*Primary Examiner*—Frederick R. Schmidt
*Assistant Examiner*—Robert Showalter

[57] ABSTRACT

A quick rotation wrench is provided and consists of a wrench body and a small handle for quick rotation of the wrench body to tighten and loosen a head of a bolt or the like.

1 Claim, 1 Drawing Sheet

WRENCHES

BACKGROUND OF THE INVENTION

The instant invention relates generally to wrenches and more specifically it relates to a quick rotation wrench.

Numerous wrenches have been provided in prior art that are adapted to manipulate nuts and bolts. For example, U.S. Pat. Nos. 1,343,692; 3,550,486 and 4,406,186 all are illustrative of such prior art. While these units may be suitable for the particular purpose to which they address, they would not be as suitable for the purposes of the present invention as heretofore described.

SUMMARY OF THE INVENTION

A primary object of the present invention is to provide a quick rotation wrench that will overcome the shortcomings of the prior art devices.

Another object is to provide a quick rotation wrench that is of a size to be used for inaccessible places that a standard wrench can not reach.

An additional object is to provide a quick rotation wrench that is constructed so that its handle will swing back and forth through a relatively small arc.

A further object is to provide a quick rotation wrench that is simple and easy to use.

A still further object is to provide a quick rotation wrench that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
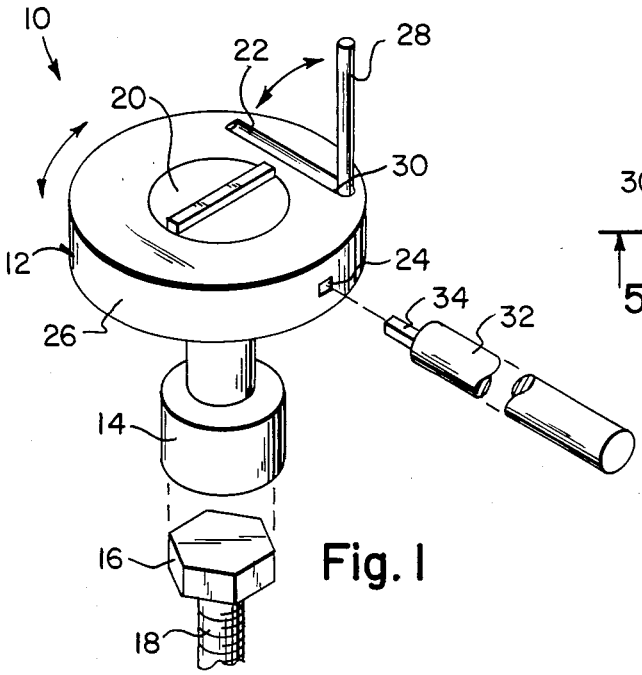
FIG. 1 is a perspective view of a first embodiment of the invention being a ratchet wrench that includes a lift up small handle for quick rotation and an adaptor plug in handle.

Turning now descriptively to the drawings, in which similar reference characters denote similar elements throughout the several views, FIG. 1 illustrates a quick rotation wrench 10 consisting of a circular wrench body 12 with a socket 14 extending downwardly for engagement with a head 16 of a bolt 18 or the like and a two way ratchet mechanism 20 within the body 12.

The wrench body 12 has a top slot 22 off center from the socket 14 and the ratchet mechanism 20 and has a square aperture 24 within side 26 thereof. A small handle 28 is pivotly mounted at one end 30 within the top slot 22 so that the handle 28 can be pulled up for quick rotation of the wrench body 12. An adapter handle 32 that has a square shank end 34 can be plugged into the square aperture 24 in the wrench body 12 for quick rotation of the wrench body 12 when the small handle 28 cannot be utilized.

Figure 2:
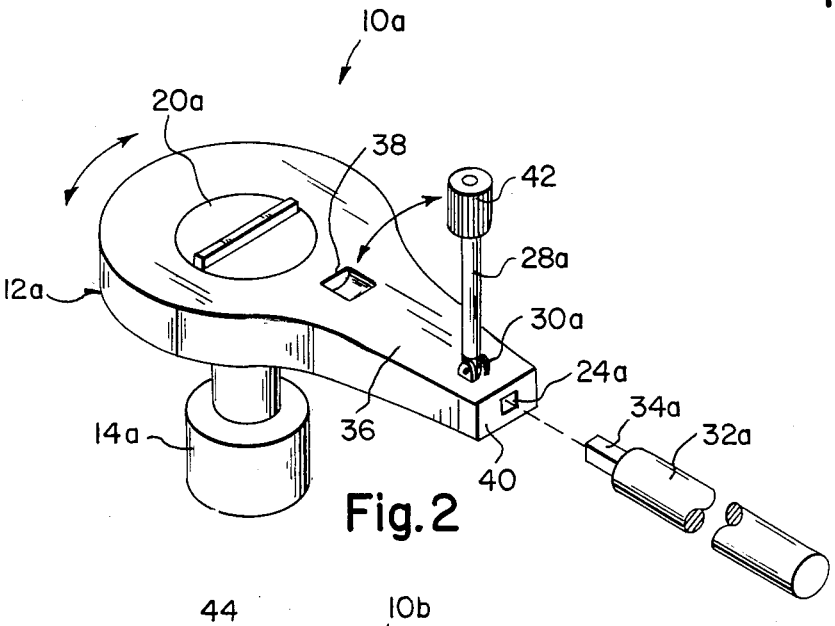
FIG. 2 is a perspective view of a second embodiment of the invention being a ratchet wrench that includes a lift up small turning knob handle and an adaptor plug in handle.

FIG. 2 shows a first modified quick rotation wrench **10*a* containing a circular wrench body 12*a* that has a neck portion 36 with a socket 14*a* extending downwardly for engagement with a head of a bolt or the like and a two way ratchet mechanism 20*a* within the body 12*a*. The neck portion 36 has a top recess 38 and a square aperature 24*a* within end 40 thereof. A small handle 28*a* that has a turn knob 42 is pivotly mounted at 30*a* at top end of the neck portion 36. The handle 28*a* can be pulled down with the turn knob 42 engaging the recess 38 when not being used. The handle 28*a* can be pulled up and the turn knob 42 gripped for quick rotation of the wrench body 12*a*. An adaptor handle 32*a* that has a square shank end 34*a* can be plugged into the square aperture 24*a* in the end 40 of the neck portion 36 of the wrench body 12*a* for quick rotation of the wrench body when the handle 32*a*** cannot be used.

Figure 3:
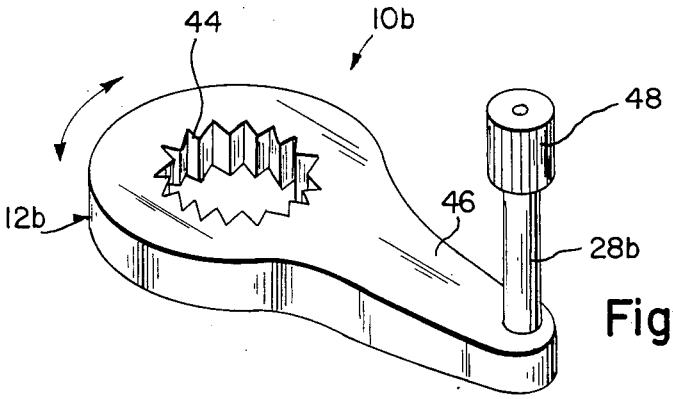
FIG. 3 is a perspective view of a third embodiment of the invention being a box end wrench that includes a fixed vertical handle having a turning knob.

FIG. 3 shows a second modified quick rotation wrench **10*b* containing a wrench body 12*b* that has a box end 44 and neck portion 46. The box end 44 is for engagement with a head of a bolt or the like. A small fixed handle 28*b* that has a turn knob 48 is fixed to and extends transversely from top end of the neck portion 46 in which the turn knob 48 can be gripped for quick rotation of the wrench body 12*b***.

Figure 4:
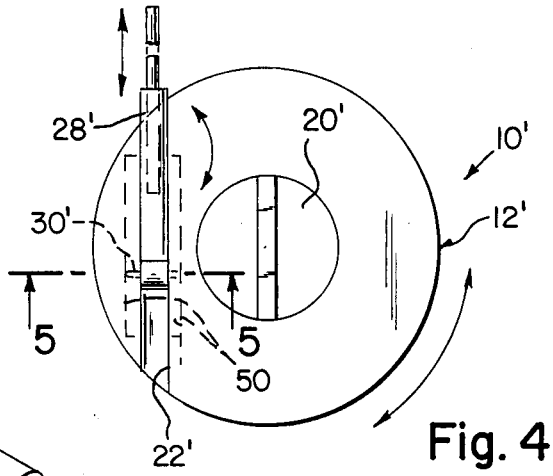
FIG. 4 is a top plan view of a fourth embodiment of the invention being a ratchet wrench having a telescopic adjustable position handle.
Figure 5:
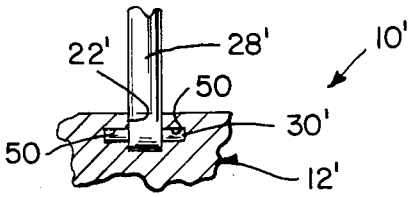
FIG. 5 is an enlarged cross sectional view taken along line 5—5 in FIG. 4 showing the tracks therein in greater detail.

FIGS. 4 and 5 shows still another modification 10' similar to the quick rotation wrench 10 in FIG. 1. The top slot 22' in the wrench body 12' has built in side tracks 50 therein. The small handle 28' is telescoping. A pivot pin 30' extends through lower end of the handle 28' and is slideable within the side tracks 50 in the top slot 22' the handle 28' can be placed in any position within the top slot 22' and be adjustable in height to increase and decrease the quick rotation of the wrench body 12'.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A quick rotation wrench comprising:

(a) a circular wrench body with a socket extending downwardly for engagement with a head of a bolt or the like and a two way ratchet mechanism within said body, said wrench body having a top slot off center from said socket and said ratchet mechanism and a circular side having a square aperture therein;

(b) a small handle pivotly mounted at one end within said top slot so that said handle can be pulled up for quick rotation of said wrench body;

(c) an adapter handle having a square shank end to plug into said square aperture in said wrench body for quick rotation of said wrench body;

(d) said top slot in said wrench body having built in side tracks therein;

(e) said small handle being telescoping; and (f) a pivot pin extending through lower end of said handle and slideable within said side tracks in said top slot so that said handle can be placed in any position within said top slot and be adjustable in height to increase and decrease said quick rotation of said wrench body.

* * * * *